US012515771B2

(12) United States Patent
Shiue

(10) Patent No.: US 12,515,771 B2
(45) Date of Patent: Jan. 6, 2026

(54) STRUCTURE OF A MASK

(71) Applicant: QBAS Co., Ltd., Taipei (TW)

(72) Inventor: Heng-Ea Shiue, Taipei (TW)

(73) Assignee: QBAS CO., LTD., Taipei (TW)

( * ) Notice: Subject to any disclaimer, the term of this patent is extended or adjusted under 35 U.S.C. 154(b) by 0 days.

(21) Appl. No.: 18/740,949

(22) Filed: Jun. 12, 2024

(65) Prior Publication Data

US 2024/0417046 A1 Dec. 19, 2024

Related U.S. Application Data

(60) Provisional application No. 63/521,572, filed on Jun. 16, 2023.

(51) Int. Cl.
*A63B 33/00* (2006.01)
*B63C 11/12* (2006.01)

(52) U.S. Cl.
CPC ..... *B63C 11/12* (2013.01); *A63B 33/002* (2013.01)

(58) Field of Classification Search
CPC .... A63B 2209/14; A63B 33/002; B63C 11/12
See application file for complete search history.

(56) References Cited

U.S. PATENT DOCUMENTS 4,955,394 A * 9/1990 Dean ..... A41D 13/1146 128/863
5,216,759 A * 6/1993 Hewitt ..... A61F 9/02 2/431
5,926,843 A * 7/1999 Winchester ..... A61D 9/00 2/22
6,131,195 A * 10/2000 Foreman ..... A63B 71/1225 602/8
6,253,387 B1 * 7/2001 Yu ..... A63B 33/004 2/445
6,604,247 B2 * 8/2003 Chiang ..... A63B 33/004 2/428
6,996,857 B2 * 2/2006 Fukasawa ..... A63B 33/004 2/428
7,900,280 B2 * 3/2011 Thorpe ..... A63B 33/004 2/428
10,012,506 B1 7/2018 Monahan et al.
(Continued)

FOREIGN PATENT DOCUMENTS

CN 109471264 A 3/2019
TW M612106 U 5/2021
(Continued)

*Primary Examiner* — Tajash D Patel
(74) *Attorney, Agent, or Firm* — MUNCY, GEISSLER, OLDS & LOWE, P.C.

(57) ABSTRACT

A structure of a mask (1) includes a frame (10), a viewing window assembly (20), and a waterproof skirt assembly (30). The face portion (32) of the waterproof skirt assembly has a circumferential contact area (33). The face portion has a first shape and is made of a material that includes a re-moldable material. When a user (U) puts on the mask through a fastening device (40), the face portion is adapted to be squeezed and deformed to be in a second shape by the user's face, whereby making the circumferential contact area be capable of further following the contour of the user's face; whereas when the user takes off the mask, the face portion remains in the second shape.

12 Claims, 3 Drawing Sheets

(56) References Cited

U.S. PATENT DOCUMENTS

| | | | | |
|---|---|---|---|---|
| 11,000,737 | B2 * | 5/2021 | Godoy | A63B 33/004 |
| 2004/0243042 | A1 * | 12/2004 | Lipman | A61F 13/122<br>602/43 |
| 2005/0081282 | A1 * | 4/2005 | Yu | A61F 9/026<br>2/428 |
| 2017/0197117 | A1 * | 7/2017 | Shiue | A63B 33/004 |
| 2020/0039617 | A1 * | 2/2020 | Oelrich | A63B 33/002 |
| 2025/0025749 | A1 * | 1/2025 | Shiue | A63B 33/004 |

FOREIGN PATENT DOCUMENTS

| | | | | |
|---|---|---|---|---|
| WO | WO-9622752 | A1 * | 8/1996 | A63B 33/004 |
| WO | WO-2021245195 | A1 * | 12/2021 | B32B 5/026 |

* cited by examiner

STRUCTURE OF A MASK

CROSS-REFERENCES TO RELATED APPLICATIONS

This patent application claims the benefit of U.S. Prov. Ser. No. 63/521,572 filed on Jun. 16, 2023, which is incorporated herein by reference in its entirety.

BACKGROUND OF THE INVENTION

Field of the Invention

The present invention relates to a structure of a face mask, especially to the structure of a mask such as swimming goggles, diving or snorkeling masks, used for water activities.

Descriptions of the Related Art

There are many styles of face masks on the market, but most of them can only be made into a common size to meet the face shapes of different people (including different ages, different races, and different genders) to lower the cost of providers. However, it is not comfortable for users to wear the free size mask, and it is not reliable for the aspect of waterproof if not wearing the mask with a correct size. To ensure waterproofing, users can only adjust the head strap tighter, but this will greatly reduce the wearing comfort. Sometimes, the mask will warp, making it more likely to leak. If several versions of different sizes are made, some of the above-mentioned problems can be solved, however, the cost of manufacturing will be greatly increased, and it may not be able to accurately meet individual needs. Moreover, for the products that are quickly phased out, it is not economical to make one mask style into multiple sizes.

In view of this, solving the above problems, at the same time or in part, has become a unanimous goal of the industry.

SUMMARY OF THE INVENTION

The primary objective of this invention is to provide a structure of a mask in which the face portion of the waterproof skirt assembly is made of a material that can be re-shaped, by using a material such as a memory material, or a material that can be deformed due to temperature changes or pressure changes. The material is made of such a material that when the user puts on the mask, the waterproof skirt assembly can further follow the contours of its contact area and be well shaped, turning it into a personalized mask that specifically fits each user. When it is necessary to change users, additional temperature changes and/or pressure changes can be applied. When another user puts on the mask again, the waterproof skirt assembly can be attached to the face and follow the contour changes of the new contact area, and then be shaped again to achieve the purpose of making the face portion of the waterproof skirt assembly be better stuck to the new face, and be capable of being deformed and shaped repeatedly.

To achieve the above objective, the present invention provides a structure of a mask, including: a frame, a viewing window assembly having a periphery, and a waterproof skirt assembly having a front portion and a face portion. The front portion and the periphery of the viewing window assembly are jointly embedded in the frame. The face portion extends rearwardly from the front portion and has a circumferential contact area. The face portion has a first shape and is made of a material that includes a re-moldable material. When a user puts on the mask through a fastening device, the circumferential contact area of the face portion can be squeezed and deformed by the user's face, whereby making the circumferential contact area be capable of further following a contour of the user's face; whereas when the user takes off the mask, the face portion remains in the second shape.

The re-moldable material can be a deformable material that is at least one of temperature-oriented and pressure-oriented.

When being subjected to a temperature between 40° C. and 110° C., the re-moldable material is adapted to change the face portion from the first shape to the second shape, and when being cooled down to a room temperature, the face portion is adapted to remain in the second shape.

When the user wears the mask tightly and receives a pressure stuck to the user's face, the re-moldable material can change the face portion from the first shape to the second shape, and allow the face portion to remain in the second shape.

The re-moldable material can also be a memory material or a material containing memory foam.

Each of the front portion and the face portion can be made of a flexible material having a hardness between 20 and 80 Shore A.

The material of the front portion can be an adhesive material.

The front portion can be made of the flexible material selected from the group consisting of thermoplastic rubber (TPR), thermoplastic polyurethane (TPU), silicone rubber, polyvinylchloride PVC or combination thereof, the face portion can be made of the flexible materials selected from thermoplastic elastomer (TPE), polyolefin elastomer (POE), ethylene-vinyl acetate (EVA), silicone rubber or combination thereof.

The front portion and the face portion can be made of different materials.

The hardness of the front portion can be greater than that of the face portion.

In aspect of manufacturing, the front portion and the face portion can be integrally formed, and the frame and the waterproof skirt assembly can also be integrally formed.

DESCRIPTION OF THE PREFERRED EMBODIMENT

Figure 1:
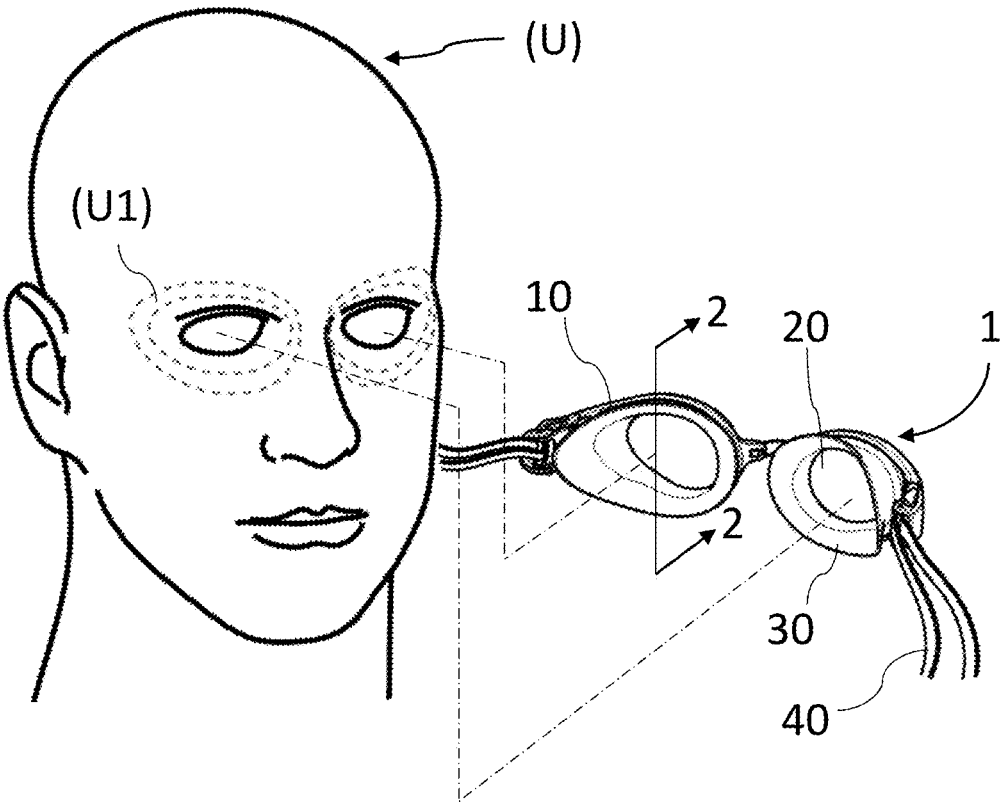
FIG. 1 is a schematic diagram of an embodiment of the mask of the present invention, which is in the state to be worn by the user.
Figure 2:
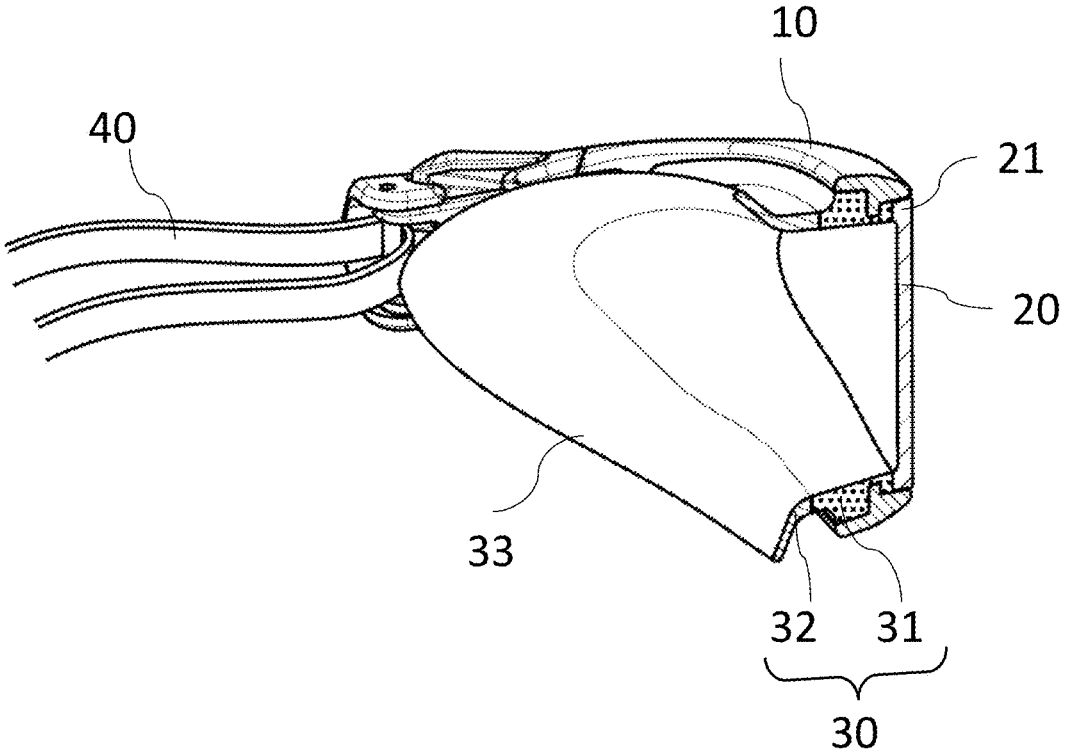
FIG. 2 is a cross-sectional view taken along line 2-2 of the mask in FIG. 1.

Referring to FIGS. 1 and 2, the structure of a mask 1 includes: a frame 10, a viewing window assembly 20 having a periphery 21, and a waterproof skirt assembly 30 having a front portion 31 and a face portion 32. The face portion 32 extends rearwardly from the front portion 31 and has a circumferential contact area 33. The front portion 31 and the periphery 21 of the viewing window assembly 20 are jointly embedded in the frame 10. The face portion 32 has a first shape and is made of a material that includes a re-moldable material. When a user (U) puts on the mask 1 through a fastening device 40, the face portion 32 is adapted to be squeezed and deformed to be in a second shape by the user's face, whereby making the circumferential contact area 33 be capable of further following a contour of the user's face; whereas when the user (U) takes off the mask 1, the face portion 32 remains in the second shape. The fastening device 40 is often connected between two outer ends of either the frame 10 or of the waterproof skirt assembly 30.

Structurally, the re-moldable material is a deformable material that is at least one of temperature-oriented and pressure-oriented. In the aspect of the temperature-oriented deformation, when the face portion 32 is subjected to a temperature between 40° C. and 110° C. and resists against the user's face, the re-moldable material is adapted to change the face portion 32 from the first shape to the second shape, and when being cooled down to a room temperature, e.g., 25° C. or so, the face portion 32 is adapted to remain in the second shape. In the aspect of the pressure-oriented deformation, when the user (U) wears the mask tightly and receives a pressure stuck to the user's face, such as a push force operated by the user (U) himself/herself, a tensile force by tightening the head strap 40, and/or the force coming from underwater pressure, the re-moldable material is adapted to change the face portion 32 from the first shape to the second shape, and allow the face portion 32 to remain in the second shape. The two parameters of deformation caused by temperature and pressure can be optional or considered at the same time. Embodiments that are deformed by temperature are not limited to the above temperatures. The temperature setting can have different "deformation-temperature" ranges according to different material properties. Even in some cases of using certain materials, when the user (U) puts on the mask 1 which can contact the skin surface of the user (U) with a body temperature for a short period of time, or which can be exposed to higher temperature outside weather, the same deformation effect can also be achieved, provided that the face portion 32 can further deform according to the user's face, whereby the circumferential contact area 33 can further follow the contour of the user's face to extend to increase waterproofness between the mask 1 and the user (U) and improve the comfort of the user (U) wearing the mask 1. The contour of the user's face in this embodiment refers to the eye socket area (U1) around the eyes, as shown in FIG. 1; whereas in other embodiments, it may refer to other surrounding areas that are sufficient to cover the eyes and nose, or the eyes, nose, and mouth of the user (U).

In the aspect of use, for example, the thermoplastic elastomer (TPE)-based material, or the polyolefin elastomer (POE), is selected as the waterproof skirt assembly 30. Before use, the face portion 32 of the waterproof skirt assembly 30 comes with a first shape. At this time, the user (U) can first place the mask 1 into warm or hot water having the temperature between 40° C. and 110° C. Alternatively, the user (U) can blow it with a hair dryer or a heat gun, or adopts other heating method such as directly contacting the mask 1 with the hot environment if being at the beach in summer. After a short period of time, such as a few seconds to tens of seconds, to allow the mask 1 to reach a temperature that can be shaped or molded, the mask 1 is then put on and pressed tightly against the user's face, for example, by tightening the head strap 40, whereby causing the face portion 32 of the waterproof skirt assembly 30 to be in close contact with the user's face and causes the circumferential contact area 33 to be capable of being closely following the contour of the user's face to extend. At this time, the face portion 32 of the waterproof skirt assembly 30 will be formed to be a second shape, allowing the circumferential contact area 33 to better conform to the user's facial contour, and therefore to complete the purpose of shaping. In addition to increasing the fit between the mask 1 and the user (U), the comfort of the original material in contact with the skin of the user (U) can still be maintained. Furthermore, when the mask 1 is in use, if the ambient temperature is still at the high temperature of being moldable, the face portion 32 of the waterproof skirt assembly 30 will continue to be shaped in a flexible way to dynamically fit with the face of the user (U); when the temperature gets lower to a specific temperature, such as room temperature e.g., 25° C. or so, the face portion 32 of the waterproof skirt assembly 30 will stop being shaped. This mode is like turning the mask into a personalized mask for the user. If different users want to use the mask, they can repeat the above steps of heating and cooling to achieve the purpose of deformation and shaping.

Figure 3A:
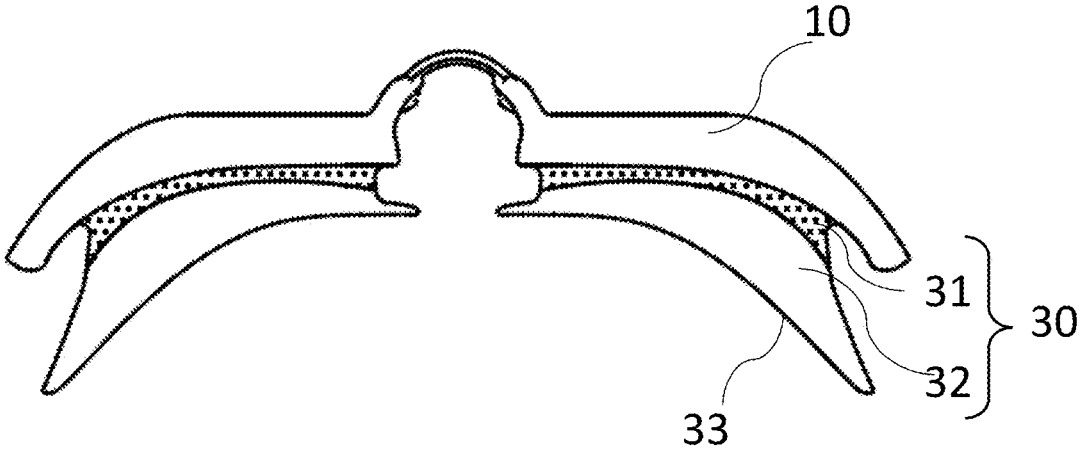
FIG. 3A is a top view of the mask of FIG. 1, illustrating that the front portion of the waterproof skirt assembly and the face portion are made of different materials, and the head strap is omitted and not shown.
Figure 3B:
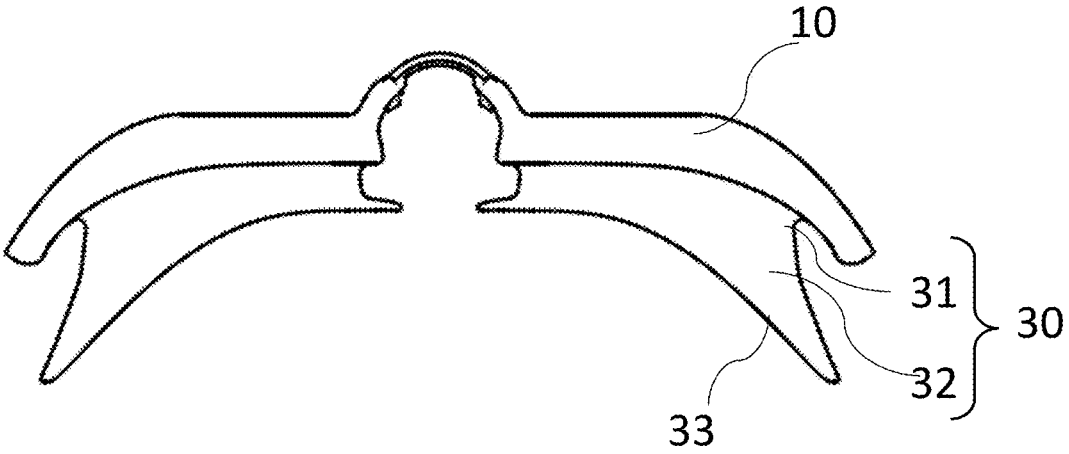
FIG. 3B is another top view of the mask of FIG. 1, illustrating that the front portion of the waterproof skirt assembly and the face are made of a same material, and the head strap is omitted and not shown.

The above-mentioned re-moldable material can be a memory material or a material containing memory material, such as memory Polyurethane (PU) foam. Alternatively, each of the front portion 31 and the face portion 32 of the waterproof skirt assembly 30 is made of a flexible material with a hardness between 20 and 80 Shore A. Preferably, the material of the front portion 31 is selected from the group consisting of thermoplastic rubber (TPR), thermoplastic polyurethane (TPU), silicone rubber, polyvinylchloride (PVC), or the combinations thereof; whereas the material of the face portion 32 is selected from the group consisting of thermoplastic elastomer (TPE), polyolefin elastomer (POE), ethylene vinyl acetate (EVA), and silicone rubber, or the combination thereof. High Temperature Vulcanized Silicone Rubber (i.e., HTV Silicone Rubber) can be the most-preferred material among silicone-based materials. The front portion 31 and the face portion 32 can be made of the same, or preferably, different materials, as shown in FIG. 3A. Better still, the hardness of the front portion 31 is greater than that of the face portion 32. The front portion 31 can be made of adhesive material to serve as a good medium for connecting the face portion 32 and the frame 10. In terms of production, the front portion 31 and the face portion 32 can be integrally formed, as shown in FIG. 3B. The frame 10 and the waterproof skirt assembly 30 can be assembled in a waterproof inlaid manner with each other, or can be integrally formed. Alternatively, the frame 10 and the front portion 31 can be injection molded for the first time, and then injection molded for the second time to be formed with the face portion 32, in order to make the entire product more reliable in aspects of integration and watertightness.

The above-described embodiments are only examples, and the drawings only use swimming goggles as an example. That is, a frame is used to match the two (left and right) viewing windows, and the two (left and right) waterproof skirts. The two viewing windows jointly define the viewing window assembly 20, and the two waterproof skirts jointly define the waterproof skirt assembly 30. However, any changes, such as applying the re-moldable waterproof skirt assembly to the face portion of other types of masks, e.g., masks for diving, snorkeling, fishing, and swimming training that only cover the user's eyes and nose (with a sealed or breathable structure inside the mask), or full-face snorkeling masks that cover the user's eyes, nose, and mouth (with a viewing window assembly covering the whole user's face or only covering the user's eyes), are all feasible. Also, whether the viewing window assembly is a one-piece type or a left-right separated type, should not be limited, and should be what the present invention intends to protect.

What is claimed is:

1. A structure of a mask, comprising:

a frame;

a viewing window assembly having a periphery;

a waterproof skirt assembly having a front portion and a face portion extending rearwardly from the front portion, in which the front portion and the periphery of the viewing window assembly are jointly embedded in the frame, and the face portion having a circumferential contact area;

wherein the face portion having a first shape and being made of a material that includes a re-moldable material, in which the re-moldable material is deformable and is at least one of temperature-oriented and pressure-oriented; when a user puts on the mask through a fastening device, the face portion is adapted to be squeezed and deformed to be in a second shape by the user's face, whereby making the circumferential contact area be capable of further following a contour of the user's face; whereas when the user takes off the mask, the face portion remains in the second shape.

2. The structure of a mask as claimed in claim 1, wherein when being subjected to a temperature between 40° C. and 110° C., the re-moldable material is adapted to change the face portion from the first shape to the second shape, and when being cooled down to a room temperature, the face portion is adapted to remain in the second shape.

3. The structure of a mask as claimed in claim 1, wherein when the user wears the mask tightly and receives a pressure stuck to the user's face, the re-moldable material is adapted to change the face portion from the first shape to the second shape, and allow the face portion to remain in the second shape.

4. The structure of a mask as claimed in claim 3, wherein the re-moldable material is a memory material.

5. The structure of a mask as claimed in claim 4, wherein the re-moldable material containing memory Polyurethane (PU) foam.

6. The structure of a mask as claimed in claim 1, wherein each of the front portion and the face portion is made of a flexible material having a hardness between 20 and 80 Shore A.

7. The structure of a mask as claimed in claim 6, wherein the front portion is made of an adhesive material.

8. The structure of a mask as claimed in claim 6, wherein the front portion is made of the flexible material selected from the group consisting of thermoplastic rubber (TPR), thermoplastic polyurethane (TPU), silicone rubber, polyvinylchloride PVC or combination thereof; the face portion is made of the flexible materials selected from thermoplastic elastomer (TPE), polyolefin elastomer (POE), ethylene-vinyl acetate (EVA), silicone rubber or combination thereof.

9. The structure of a mask as claimed in claim 8, wherein the front portion and the face portion are made of different materials.

10. The structure of a mask as claimed in claim 9, wherein the front portion is harder than the face portion.

11. The structure of a mask as claimed in claim 10, wherein the front portion and the face portion are integrally formed.

12. The structure of a mask as claimed in claim 1, wherein the frame and the waterproof skirt assembly are integrally formed.

* * * * *